US005735954A

United States Patent [19]

Zeitler

[11] Patent Number: 5,735,954

[45] Date of Patent: Apr. 7, 1998

[54] EXPANDABLE STAMP PAD ASSEMBLY

[75] Inventor: Lothar Zeitler, Kulmbach, Germany

[73] Assignee: Noris-Color GmbH, Kulmbach, Germany

[21] Appl. No.: 719,978

[22] Filed: Sep. 24, 1996

[30] Foreign Application Priority Data

Nov. 14, 1995 [DE] Germany ..... 295 18 038.2

[51] Int. Cl.[6] ..... B05C 1/06

[52] U.S. Cl. ..... 118/264; 118/46; 118/269; 101/333

[58] Field of Search ..... 118/46, 264, 269; 101/327, 333

[56] References Cited

U.S. PATENT DOCUMENTS

| | | | |
|---|---|---|---|
| 2,017,508 | 10/1935 | Munson | 118/269 |
| 2,932,906 | 4/1960 | Chamberlin | 118/264 |
| 2,938,292 | 5/1960 | Jaskowsky et al. | 118/264 |
| 3,215,073 | 11/1965 | Robinson | 101/333 |
| 3,590,734 | 7/1971 | Carter | 101/333 |
| 4,375,191 | 3/1983 | Dickey | 101/333 |
| 5,505,130 | 4/1996 | Winston | 101/333 |
| 5,601,644 | 2/1997 | Yasoshima | 118/46 |

*Primary Examiner*—Donald E. Czaja
*Assistant Examiner*—Michael P. Colaianni
*Attorney, Agent, or Firm*—Dennison, Meserole, Pollack & Scheiner

[57] ABSTRACT

A stamp pad including a base part with peripheral walls surrounding and supporting an ink member, the walls having connector elements which enable a releasable engagement of multiple stamp pads in side by side relation to form an assembly of multiple pads with a substantially continuous ink surface.

11 Claims, 6 Drawing Sheets

EXPANDABLE STAMP PAD ASSEMBLY

FIELD OF THE INVENTION

The invention relates to a stamp pad with a base part which has a seating area, defined by lateral walls, for at least one element containing stamp pad ink.

BACKGROUND OF THE INVENTION

Stamp pads of this type have been a part of the known prior art for a long time. They are designed in such a way that the base part, which in its seating area has an element containing stamp pad ink, can be closed by a cover, for example, after which the entire unit is protected from outside effects and against drying.

The disadvantage with the stamp pads known up to now lies in that no options for expansion are provided, i.e. it was not possible to combine several stamp pads, whose elements containing the same stamp pad ink arranged on the seating area, into one compact unit.

OBJECT AND SUMMARY OF THE INVENTION

Accordingly, it is the object of the instant invention to create a stamp pad of the type mentioned above which can be redesigned into a larger unit in a simple manner.

This object is attained in accordance with the invention in that the base part has at least one connecting element, on at least one of the lateral walls, which can releasably engage at least one cooperating connecting element disposed on a lateral base wall of a further stamp pad. By means of this combination of at least one connecting element and at least one cooperating connecting element matched to it on the lateral walls of adjoining stamp pads there is the possibility of lining up any arbitrary number of stamp pads in the manner of a building block system and in this way creating a larger assembly. Since the connecting elements are releasably connected with each other, it is possible to expand or reduce the assembly as desired and needed.

In a further embodiment of the invention, each lateral base wall can be provided with at least one connecting, or cooperating element. In this way the stamp pad can be connected on all its lateral walls with other stamp pads. If a structural shape of each base part with lateral walls which are disposed at right angles to each other is provided, each lateral wall of the base part of adjoining stamp pads can be provided with a connecting element and a cooperating element.

The connecting and cooperating elements are preferably projections and recesses, with the projections designed, for example, as ribs pins, bars or the like for engaging the recesses.

With a stamp pad having a square base part, each lateral wall can have a perpendicularly extending rib in one end area, and in the other end area a perpendicular recess. In this case the rib and the recess can be shorter than the height of the respective lateral base wall. A particularly advantageous embodiment results when the height of the rib and of the recess is less than half the height of the lateral wall of the base part.

Alternatively, there is also the possibility in connection with a stamp pad with a square base part, that respectively oppositely located lateral walls of the base part are provided with a longitudinally extending engagement bar, or with a recess matching it. In this case the height of the engagement bar embodied in an L-shape can be less than half the height of the lateral wall.

In a further embodiment of the invention, the stamp pad can also be designed from at least three lateral walls of the base part placed at angles in respect to each other. In this case each lateral wall can have at least one resilient pin or a cooperating recess.

In order to achieve a uniform shape of several stamp pads combined into a unit or assembly, the seating area for elements containing stamp pad ink can be flush with the lateral walls or slightly project past them. By means of this it is assured that a uniform surface is provided even with a larger unit, without it being interrupted by the lateral walls of adjoining stamp pads.

In a further embodiment of the invention there is the possibility of disposing several base parts in one housing, wherein for example the housing can consist of two housing parts which can be connected with each other by connecting elements and can be covered by a lid.

The housing can have a circumferential groove into which the rim of the cover can be inserted. Further than that, the housing can have an engagement opening on the bottom of each base part in order to be able to lift the respective base part easily out of the housing. For a functionally dependable arrangement of the base parts inside the housing, the latter can have cutouts on the inside of a rim for seating elements of the base parts. For example, in accordance with the invention there is the possibility for the housing to be embodied rectangularly and intended for receiving sixteen base parts.

The invention will be explained in more detail in what follows by means of exemplary embodiments represented in the drawings.

DETAILED DESCRIPTION OF THE PREFERRED EMBODIMENTS

Figure 1:
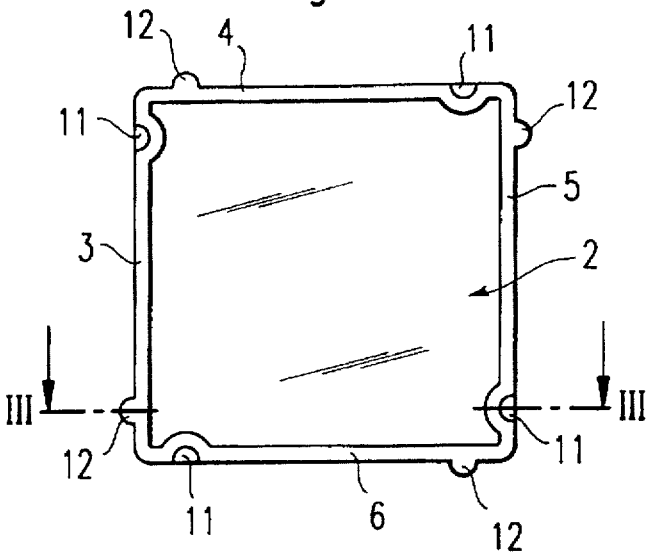
FIG. 1 is a bottom view of a base part of a stamp pad with connecting and cooperating elements.
Figure 2:
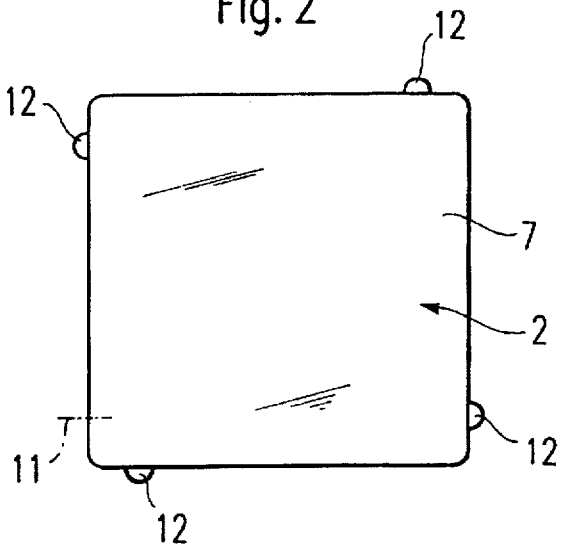
FIG. 2 is a top view of the base part of FIG. 1.
Figure 3:
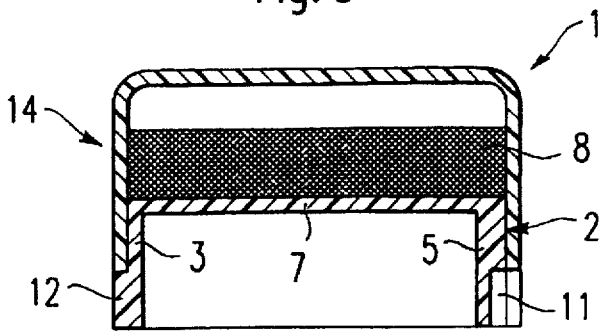
FIG. 3 is a section along the line III—III in FIG. 1, with a cover.

FIGS. 1 and 2 show a base part 2 of a stamp pad 1 in a bottom and a top view. This stamp pad 1 is represented in FIG. 3 in a section along III—III of FIG. 1 with the base part 2 having a seating area 7. An element or member 8 containing stamp pad ink is fixedly disposed (for example by adhesive) on this seating area 7. It can be covered by a cover 14.

In the embodiment in accordance with FIGS. 1 to 3, the base part 2 is shown rectangular and has four lateral walls 3, 4, 5, 6. As shown in FIGS. 1 to 3, each lateral wall has a connecting element comprising a projection 12 and a cooperating element or projection receiver 11 toward the ends thereof. The projection 12 and the receiver 11 respectively alternate about the lateral walls 3, 4, 5, 6.

It can be seen in FIG. 3 in particular, that the projection 12 is embodied as a perpendicularly extending rib 12, which is matched to the receiver 11 embodied as a cooperating perpendicular recess 11. The rib 12 and the recess 11 is here shorter than the height of the respective lateral wall 3, 4, 5 or 6 of the base part. The rib of one base part can be placed into the recess of another base part.

The height of the rib 12 and of the recess 11 can be less than half the height of the lateral wall of the respective base part 2.

If the cover 14, shown in section in FIG. 3, is removed from the stamp pad 1, the element 8 containing the stamp pad ink lies open. It is now possible to combine several stamp pads 1 into an assembly or solid structural unit, wherein a recess of an adjoining stamp pad is pushed over a rib 12 of the stamp pad 1, wherein simultaneously a rib of the adjoining stamp pad engages the recess 11 of the stamp pad 1.

Figure 4:
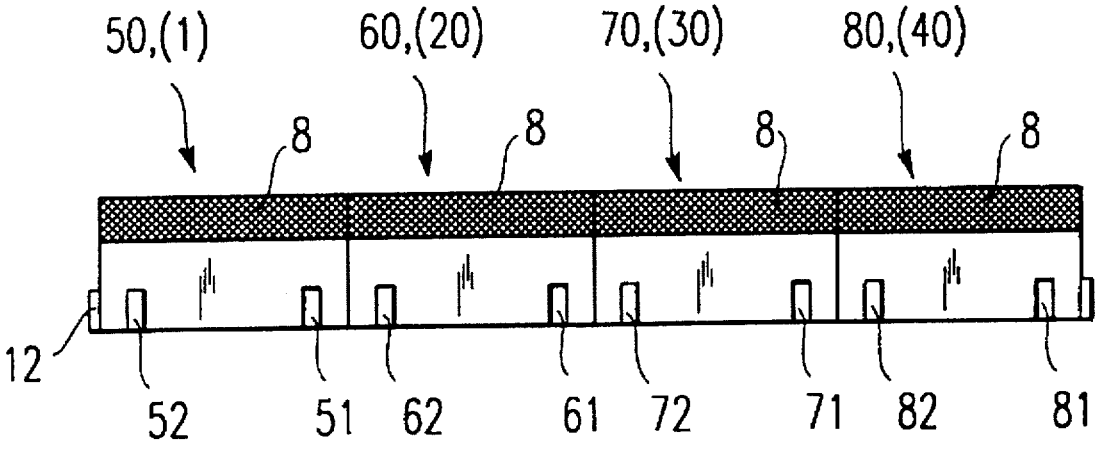
FIG. 4 is a lateral view of several stamp pads combined into a larger assembly.
Figure 5:
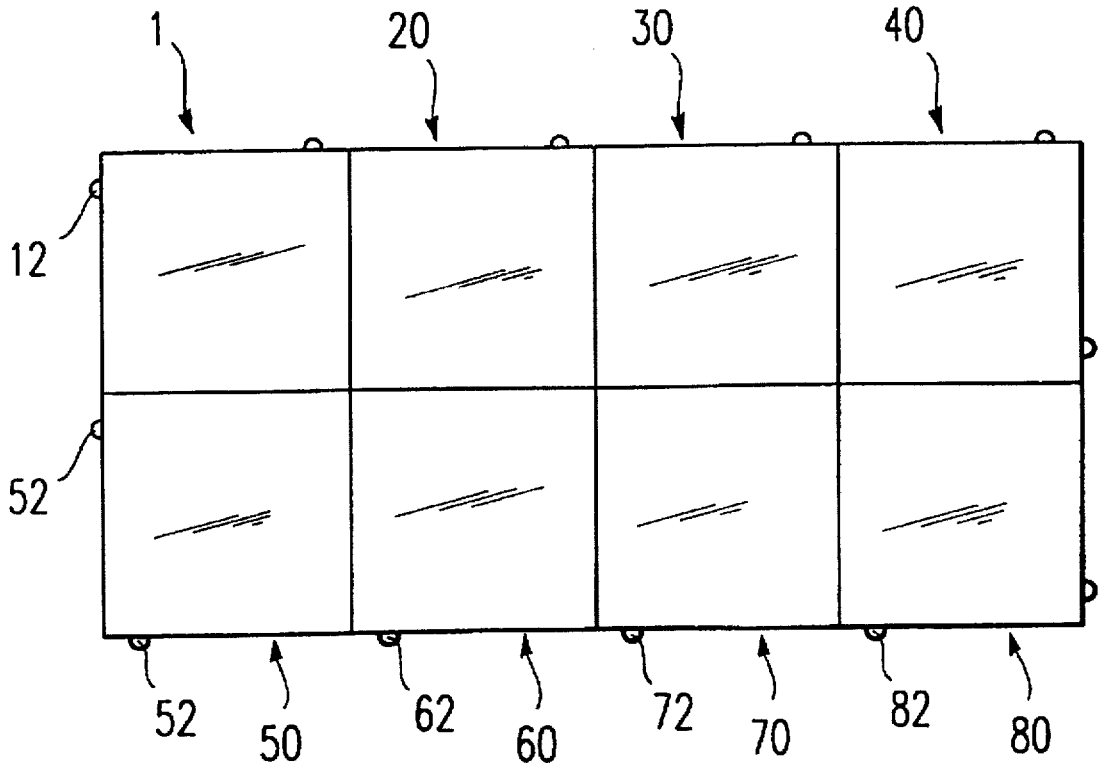
FIG. 5 is a top view of the assembly in FIG. 4.

In accordance with FIGS. 4 and 5, several stamp pads 1, 20, 30, 40, 50, 60, 70, 80 can be combined into a larger unit, which is provided as a compact assembly, by means of this cooperation of projection or rib elements 12, 52, 62, 72, 82 with corresponding receiver or recess elements 11, 51, 61, 71, 81. This structural assembly can be reduced or expanded as desired, since there are projections on the lateral walls of the respective stamp pads 1 and 20 to 80, which can be connected with corresponding receivers of further stamp pads.

Figure 6:
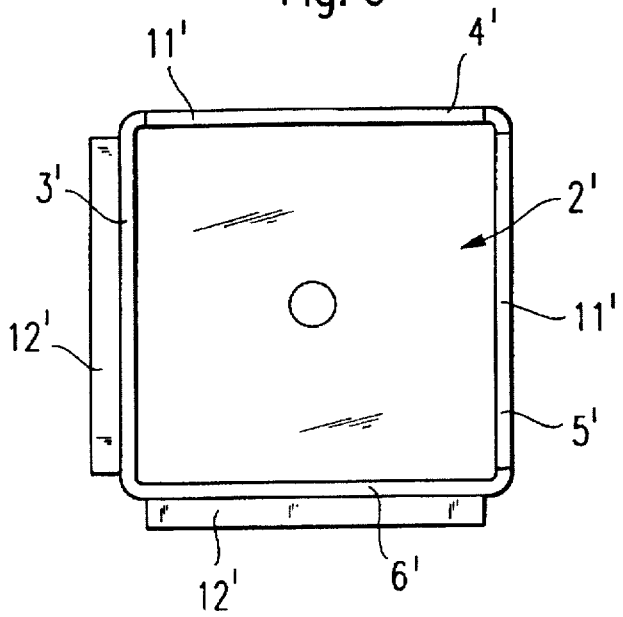
FIG. 6 is another embodiment possibility of the stamp pad with a bottom view of a differently designed base part.
Figure 7:
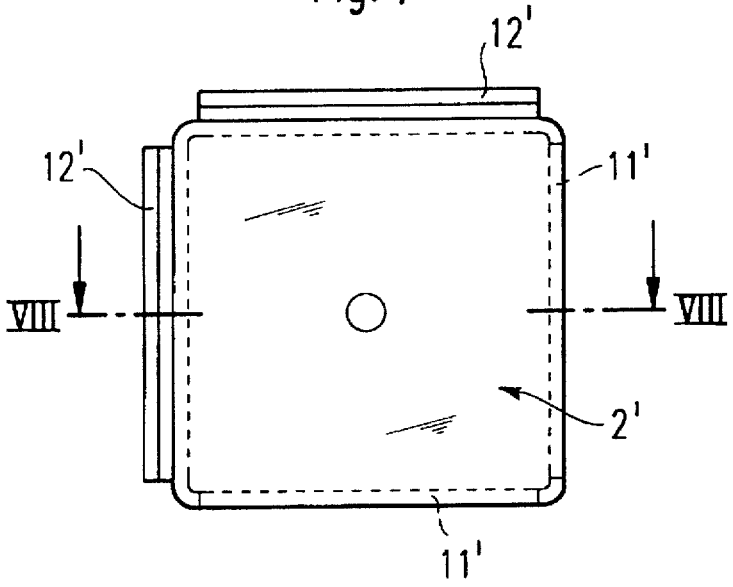
FIG. 7 is a top view of the base part in FIG. 6.
Figure 8:
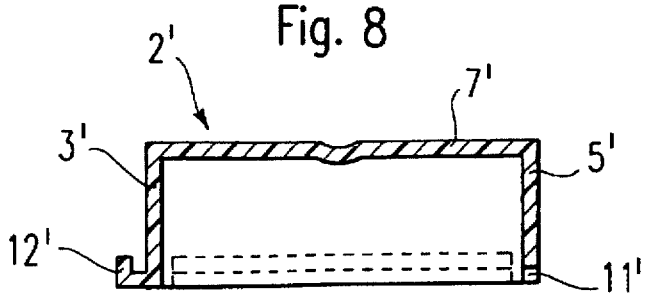
FIG. 8 is a section along the line VIII—VIII in FIG. 7.

While perpendicular ribs and recesses are provided as projections and receivers in the embodiments in accordance with FIGS. 1 to 3, there is the possibility in connection with the embodiments according to FIGS. 6 to 8, that the projection 12' is embodied as a longitudinally extending L-shaped engagement bar and the receiver 11' as an elongate recess matched to it.

Figure 9:
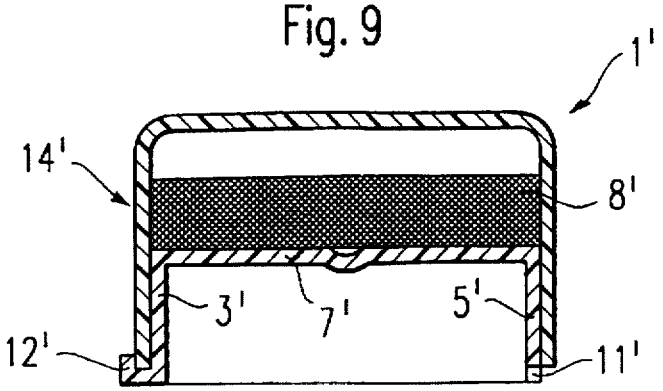
FIG. 9 shows a single stamp pad closed by a cover.

FIG. 6 shows the bottom view of a base part 2' with bars 12' placed at right angles with each other and oppositely located recesses 11'. It can be seen in FIGS. 7 and 8 that 12' is designed as an engagement bar in the shape of an L, wherein the height is less than half the height of the respective lateral wall 3' or 6'. The remaining walls are designated 4' and 5'. There is again the option in accordance with FIG. 9, to close off a single stamp pad 1' by means of a cover 14' to protect the element 8' containing the stamp pad ink and disposed on the seating area 7' against dirt or drying out.

Figure 10:
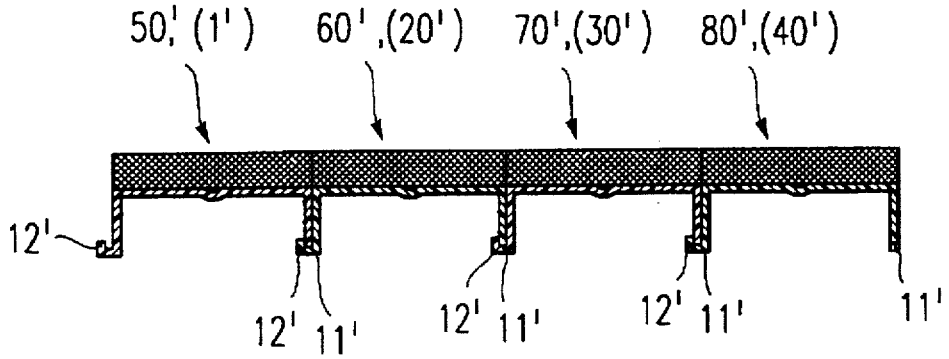
FIG. 10 is a lateral view of several stamp pads combined into a larger assembly of the elements of FIGS. 6 to 8 in cross section.
Figure 11:
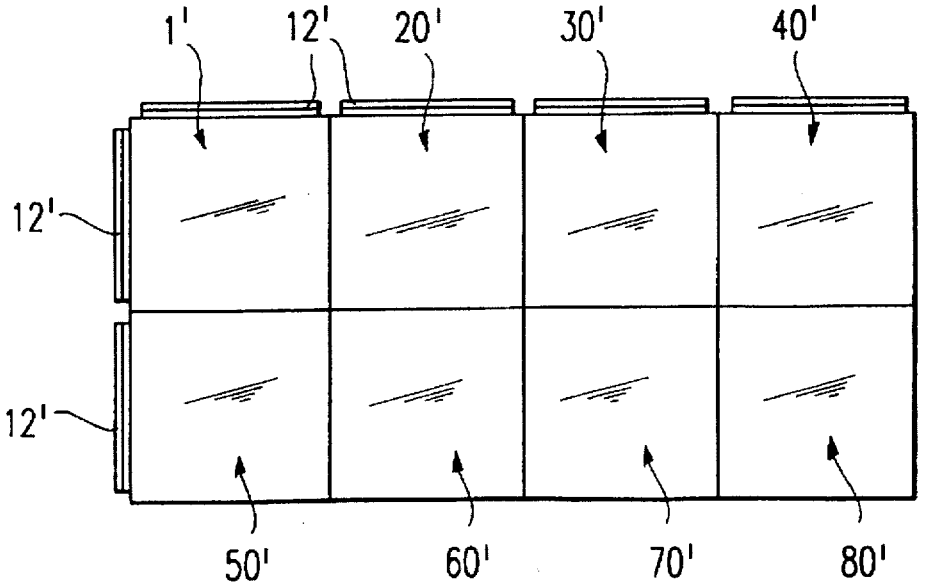
FIG. 11 is a top view of the assembly in FIG. 10.

Analogously with the embodiment in accordance with FIGS. 4 and 5, several stamp pads 1', 20' to 80' can be combined into a larger structural unit or assembly in that the recesses 11', receive the L-shaped engagement bars 12' of the adjoining base parts 2'. Because of this, there is also the possibility in accordance with FIGS. 10 and 11 to combine, for example, eight stamp pads into a larger and compact structural unit.

Figure 12:
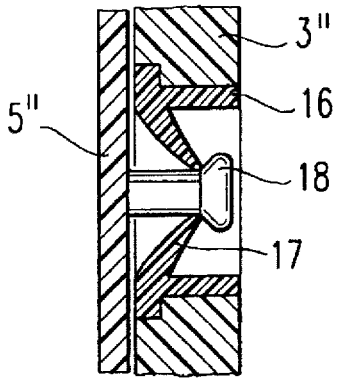
FIGS. 12 to 14 represent different embodiment options of connecting and cooperating elements.

In accordance with FIG. 12, the lateral wall 5" of one base part can alternatively by provided with a projection in the form of a pin 18, which has an enlarged head. The adjoining lateral wall 3" of another base part has the receiver or recess in the form of an insert 16 which is placed into an opening and is provided with a circumferential detent lip 17. In the assembled state, the pin 18 extends with the enlarged head behind the detent lip 17, so that the two lateral walls 3" and 5" of adjoining base parts of stamp pads are connected with each other by means of the projection and the recess.

Figure 13:
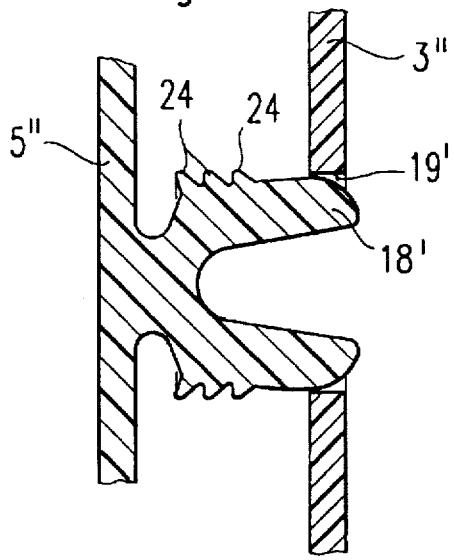

A further embodiment results in accordance with FIG. 13 in that the projection is embodied as a slit resilient pin 18' which has circumferential and resilient detent rings 24. The recess in lateral wall 3" is a through-opening 19', behind which at least one of the detent rings 24 of the projection 18' can be seated. The projection 18' can be made integral with the lateral wall 5" of the one base part.

Figure 14:
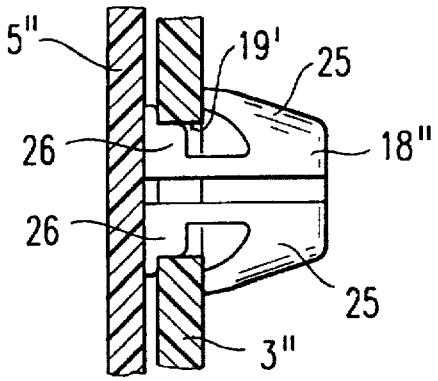

Another embodiment of a projection and receiver or recess is shown partially in section in FIG. 14. Here, the lateral wall 5" of a base part of a stamp pad has a slit, resilient pin 18" which is provided with guide bars 26. Two detent fingers 25 of the resilient pin 18" extend behind the opening 19' in the lateral wall 3" of the adjoining base part and in this way connect the lateral walls 3" and 5" of adjoining stamp pads in a functionally dependable way with each other. A dependable fastening and stabilizing of the entire structural unit is assured by the guide bars 26 received in the opening.

It is also structurally conceivable to provide two adjoining stamp pads with at least one connecting element each and to connect both elements with each other by means of a third part, for instance a clamp.

In accordance with the invention there is also the possibility of placing several base parts in one housing. In accordance with FIGS. 15 to 17, the housing 60 can consist of two housing parts 60.1 and 60.2, which can be connected with each other by means of connecting and cooperating elements 65. These elements 65 are, for example, clip connectors known per se and are preferably disposed on the two sides of the two housing parts 60.1 and 60.2 facing each other. In accordance with FIG. 15, the housing put together in this way from the two housing parts 60.1 and 60.2 can be closed off by a cover 61.

Figure 15:
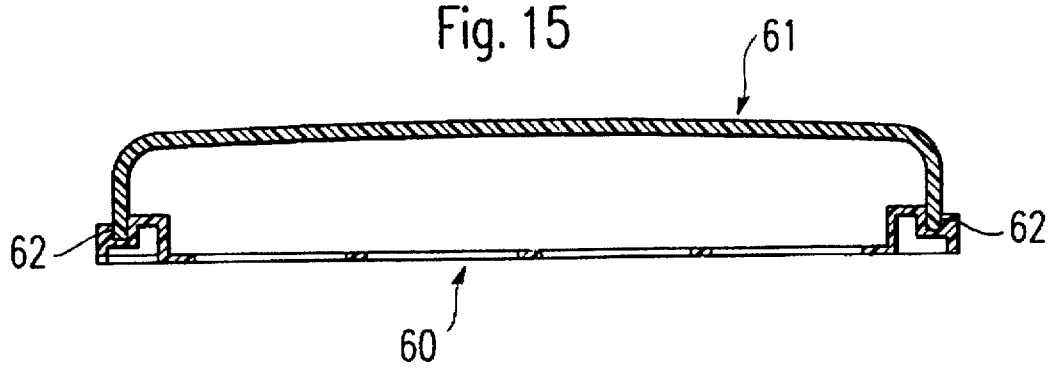
FIG. 15 is a lateral sectional view of a housing with cover for receiving the base parts.
Figure 16:
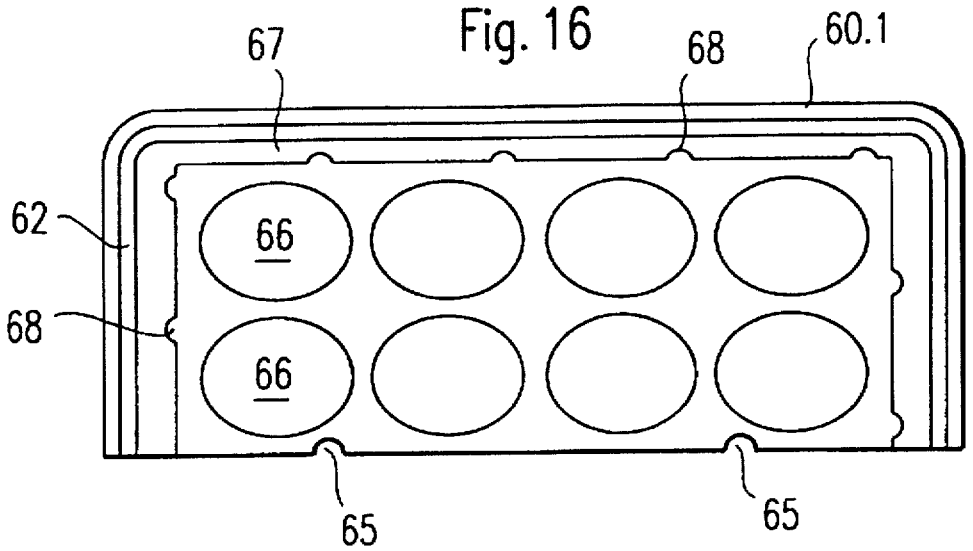
FIGS. 16 and 17 represent two housing parts in a top view.
Figure 17:
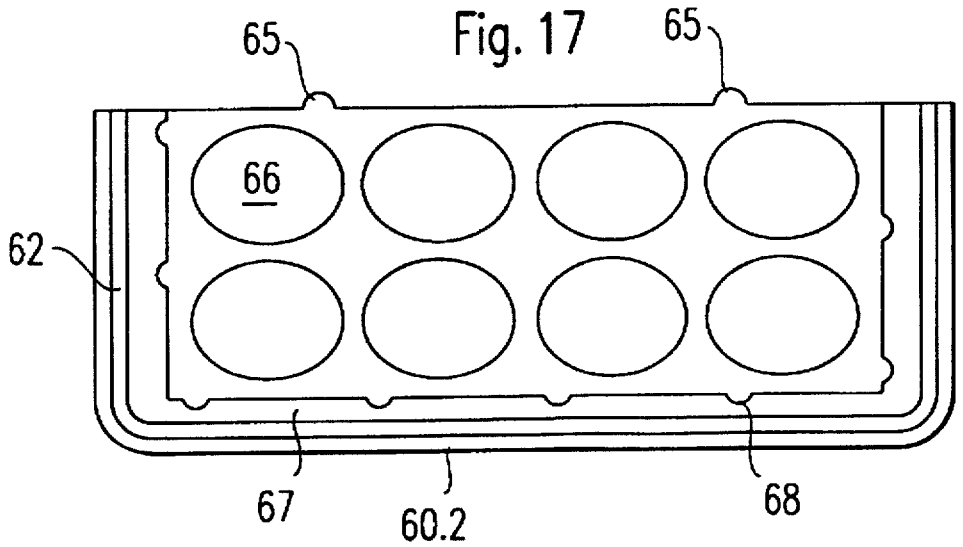

It can be seen from FIGS. 15 to 17 that the housing has a circumferential groove 62 in which the edge of the cover can be inserted. In this way a closed unit for receiving a number of base parts is the result.

This housing 60 can have an engagement opening 66 under each base part 2, 2'. In this case it is possible to lift a base part 2 or 2' disposed in the housing 60 in a simple manner by engagement of the base parts through the openings 66 from below.

In order to dispose the respective base parts 2, 2' secure against displacement in the housing 60, this housing 60 can have cutouts 68 for the insertion of elements of the base parts 2, 2' on the inside of a rim 67.

It can be seen in FIGS. 16 and 17 that the housing 60 can be rectangular and is used for receiving sixteen base parts 2, 2'. Accordingly, sixteen engagement openings 66 are provided for lifting the respective base parts out of the housing when required.

As a whole it is assured in a simple manner that several stamp pads can be releasably connected with each other on their lateral walls by means of cooperating elements in such a way that a structural unit results which can be expanded or reduced as desired and is exactly suited to the requirements of the respective situation.

What is claimed is:

1. An expandable stamp pad assembly comprising multiple adjacent stamp pads; each pad comprising a base with a seating area having upper and lower surfaces and peripheral walls about said seating area, and ink-carrying member substantially coextensive with and affixed to said upper surface and extending above said peripheral walls, selected ones of said peripheral walls having first connecting elements fixed thereto and extending laterally outward therefrom relative to said base seating area, and selected ones of said peripheral walls having second connecting elements thereon to receive and secure said first connecting elements of adjacent ones of said stamp pads positioned with the walls of adjacent pad bases in parallel adjoining relation to each other wherein an expansion of said stamp pad assembly extends, unrestricted, laterally outward from each of said peripheral walls having said connecting elements thereon.

2. The stamp pad assembly of claim 1 wherein each of said peripheral walls of said stamp pads has at least one of said first and second connecting elements thereon for an expansion of said stamp pad assembly from each peripheral wall of each stamp pad base.

3. The stamp pad assembly of claim 2 wherein said seating area of each stamp pad base, and the peripheral walls thereon, define a rectangular configuration with adjacent walls at right angles to each other.

4. The stamp pad assembly of claim 2 wherein each of said walls has both a first connecting element and a second connecting element thereon.

5. The stamp pad assembly of claim 2 wherein said first connecting element comprises a projection extending laterally outward from the corresponding wall, said second connecting element comprising a recess defined in the associated wall and configured for close reception of a first connecting element projection of an adjacent pad base.

6. The stamp pad assembly of claim 5 wherein each of said walls is planar, each first connecting element projection comprising an elongate bar, each of said second connecting element recesses being defined completely through the associated wall for extension of the companion bar therethrough.

7. The stamp pad assembly of claim 6 wherein said walls of each stamp pad depend below the seating area, said bars and recesses being of a height less than that of the associated walls.

8. The stamp pad assembly of claim 7 wherein the height of each bar and recess is less than one-half the height of the associated walls.

9. The stamp pad assembly of claim 1 wherein the seating area of each stamp pad base extends completely over the peripheral walls thereof wherein said ink-carrying members of adjacent stamp pads substantially engage each other and define a continuous ink-carrying member surface.

10. For use in an expandable stamp pad assembly comprising multiple adjacent stamp pads; a stamp pad comprising a base with a seating area having upper and lower surfaces and peripheral walls about and depending from said seating area, an ink-carrying member substantially coextensive with and affixed to said upper surface of said base and extending above and over said peripheral walls, each of said peripheral walls having at least one connecting element thereon wherein duplicate adjacent stamp pads can be assembled to each of said peripheral walls with ink carrying members of adjacent pads in engagement with each other.

11. The stamp pad of claim 10 wherein each of said peripheral walls includes both a first connecting element and a second connecting element, said first connecting element comprising a projection, said second connecting element being configured to receive one of said projections.

* * * * *